United States Patent [19]

Stauffer

[11] Patent Number: 4,744,736

[45] Date of Patent: May 17, 1988

[54] COMPOUND ROTARY INTERNAL COMBUSTION ENGINE

[76] Inventor: John E. Stauffer, 6 Pecksland Rd., Greenwich, Conn. 06830

[21] Appl. No.: 943,634

[22] Filed: Dec. 19, 1986

Related U.S. Application Data

[63] Continuation-in-part of Ser. No. 773,636, Sep. 9, 1985.

[51] Int. Cl.[4] ..... F02B 53/00

[52] U.S. Cl. ..... 418/35

[58] Field of Search ..... 123/245; 418/33, 34, 418/35

[56] References Cited

U.S. PATENT DOCUMENTS

| | | | |
|---|---|---|---|
| 1,224,642 | 5/1917 | Holmes | 418/35 |
| 1,353,374 | 9/1920 | Arrighi | 418/33 X |
| 1,962,408 | 6/1934 | Powell | 418/36 |
| 2,088,779 | 8/1937 | English | 418/35 |
| 3,294,071 | 12/1966 | Turco | 418/35 |

FOREIGN PATENT DOCUMENTS

| | | | |
|---|---|---|---|
| 920601 | 1/1947 | France | 418/35 |

*Primary Examiner*—Michael Koczo
*Attorney, Agent, or Firm*—Krass & Young

[57] ABSTRACT

An internal combustion engine of the rotary type in which a pair of axially spaced combustion chambers are provided and a common ratchet or control mechanism is positioned between the spaced combustion chambers. A pair of vanes are mounted in each combustion chamber with the vanes mounted on concentric shafts and free to rotate relative to each other. The ratchet mechanism positioned between the combustion chambers functions to resist counterclockwise movement of the vanes in one combustion chamber while allowing free clockwise movement thereof and to resist clockwise movement of the vanes in the other combustion chamber while allowing free counterclockwise movement thereof. The reaction forces generated in the ratchet mechanism from the two combustion chambers thus tend to cancel each other out. The central ratchet mechanism includes a housing which absorbs the reaction forces from both combustion chambers and which is free to rotate in the event that the reaction forces generated in the two combustion chambers become unbalanced.

8 Claims, 2 Drawing Sheets

COMPOUND ROTARY INTERNAL COMBUSTION ENGINE

RELATED APPLICATION

This application is a continuation-in-part of U.S. patent application Ser. No. 773,636, pending, filed on Sept. 9, 1985.

TECHNICAL FIELD

This invention relates to drive assemblies and more particularly to a drive assembly that is particularly suitable for use as a rotary internal combustion engine.

BACKGROUND OF THE INVENTION

A multitude of designs have been proposed for rotary internal combustion engines over the years and yet, despite the multiplicity of such rotary designs, and despite the obvious advantages of the unidirectional movement inherent in the rotary design, the reciprocating variety of engine continues to account for the vast majority of internal combustion engines sold. This presumably is because the various rotary designs proposed have either been too complex to manufacture on a large scale, have been inefficient in operation, have required an inordinate amount of maintenance, or have had a relatively short product life.

This invention relates to a rotary internal combustion engine of the type in which two rotating pistons or vanes are connected to concentric shafts or hubs with the leading and following pistons rotating in a manner that allows the pistons to alternately approach and move away from each other to permit the intake of a combustible fuel mixture, its compression, ignition, expansion and exhaust. Prior art rotary internal combustion engines of this type have suffered from an inability to convert the somewhat promiscuous and seemingly random movement of the two pistons into a predictable, usable movement of an output shaft. Prior art attempts to provide a predictable or usable movement of the output shaft have involved the attempted use of a predetermined program to control the compression and expansion strokes wherein a fixed program of motion between the pistons is established by the use of cams, lobes, planetary gears, cranks, grooves, slots, rollers or other similar linkages. However, these prior art attempts to provide a predictable, usable movement of the output shaft by providing a predetermined fixed program of motion between the pistons have been unsuccessful since they have generated uncompensated stresses which have tended to literally tear the engine apart. They have also resulted in engine designs that are unduly complex, unduly expensive to manufacture, and which require an inordinate amount of maintenance.

A rotary internal combustion engine overcoming many of these problems with the prior art rotary internal combustion engine designs is disclosed in applicant's copending patent application Ser. No. 773,636. The engine of that application includes a housing; a first piston or vane mounted for rotation in the housing on a fixed axis; a second piston or vane mounted for rotation in the housing on the fixed axis independently of the first vane; means precluding rotation of either vane in one direction about the axis while allowing free rotation in the other direction about the axis so that the vanes may rotate freely in the other direction and may simultaneously undergo relative rotation; and converter means, including an output shaft, drivingly connected to the vanes and operative to convert the rotation of the vanes in such other direction as well as the relative rotation of the vanes into a unidirectional, steady speed rotation of the output shaft of the converter means. Whereas this engine design eliminates many of the problems of the prior art rotary internal combustion engines, the means provided to confine the rotation of the vanes to a single direction may, in certain applications, generate undesirable engine vibration because of the reaction forces being absorbed by the rotation confining means.

SUMMARY OF THE INVENTION

This invention is directed to the provision of an improved rotary internal combustion engine of the rotary piston type. More specifically, this invention is directed to the provision of an improved rotary internal combustion engine which retains all of the advantages of the engine of Ser. No. 773,636 while eliminating the reactive vibrations generated in that engine.

In the invention engine, the engine housing defines first and second chambers; a first pair of vanes is mounted in the first chamber for independent rotation on a common fixed engine axis; a second pair of vanes is mounted in the second combustion chamber for independent rotation about the fixed axis; first control means are provided to resist rotation of the first pair of vanes in a counterclockwise direction about the axis while allowing free rotation in a clockwise direction about the axis so that the first pair of vanes may rotate freely in the first chamber in a clockwise direction and may simultaneously undergo relative rotation in the chamber; and second control means are provided to resist rotation of the second pair of vanes in a clockwise direction about the axis while allowing free rotation in a counterclockwise direction about the axis so that the second pair of vanes may rotate freely in the second chamber in a counterclockwise direction and may simultaneously undergo relative rotation within the second chamber. This arrangement allows the reactive forces generated by the vanes of the first combustion chamber to be counterbalanced by the reactive forces generated by the vanes of the second combustion chamber.

According to a further feature of the invention, the first and second combustion chambers are axially spaced and the control means are positioned between the axially spaced chambers. This arrangement provides a compact engine package and simplifies the process of placing the reactive forces generated in the two combustion chambers in counterbalancing relation.

According to a further feature of the invention, the control means comprises a housing positioned between the first and second chambers and mounted for rotation about the axis; first ratchet means drivingly interconnecting the first pair of vanes to the housing and operative to allow clockwise movement of the first pair of vanes relative to the housing while precluding relative counterclockwise movement; and second ratchet means drivingly interconnecting the second pair of vanes to the housing and operative to allow counterclockwise movement of the second pair of vanes relative to the housing while precluding relative clockwise movement. This arrangement allows reactive forces from both combustion chambers to be applied to a common housing and allows the housing to undergo rotation in the event that the reaction forces generated by the respective chambers become unbalanced.

In the disclosed embodiment of the invention, the vanes of the first pair of vanes are respectively secured to a first pair of concentric shafts positioned on the engine axis; the vanes of the second pair of vanes are respectively secured to a second pair of concentric shafts positioned on the engine axis; both pairs of concentric shafts extend out of one side of their respective combustion chamber into the space between the chambers for coaction with the counterbalancing ratchet means; the pair of concentric shafts associated with the first combustion chamber extends out of the other side of that chamber to a first converter means which includes a first output shaft and which operates to convert the clockwise rotation of the first pair of vanes and the relative rotation of the first pair of vanes into unidirectional rotation of the first output shafts; and the pair of concentric shafts associated with the second combustion chamber extends out of the other side of that combustion chamber for coaction with a second converter means which includes a second output shaft and which functions to convert the counterclockwise rotation of the second pair of vanes and the relative rotation of the second pair of vanes into unidirectional rotation of the second output shaft.

According to a further feature of the invention, the engine further includes a central output shaft positioned on the axis rotatably within the first and second pairs of concentric shafts and extending from the first output shaft, through the first combustion chamber, through the control means housing, through the second combustion chamber, and through the second converter means so as to deliver the power from both output shafts to one end of the engine for appropriate power takeoff.

DETAILED DESCRIPTION OF THE PREFERRED EMBODIMENT

Figure 1:
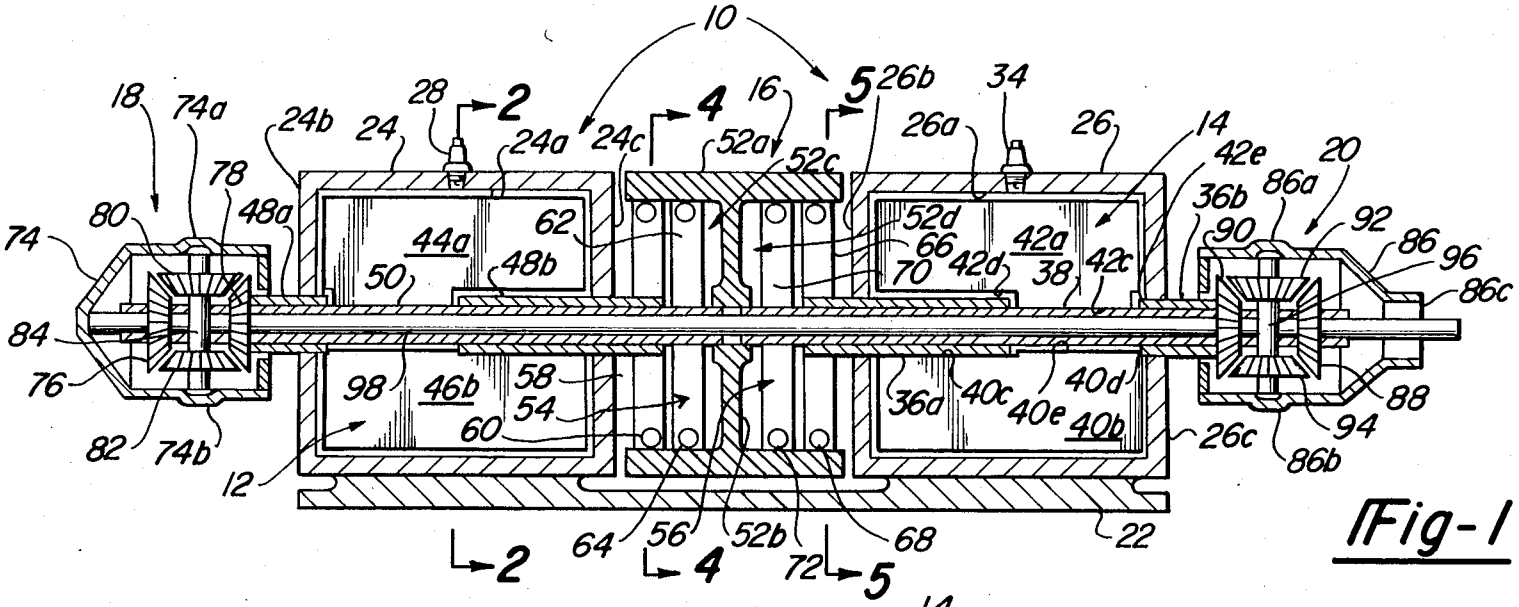
FIG. 1 is a schematic, longitudinal cross-sectional view of the invention engine.

The invention engine, broadly considered, comprises a housing means 10; a first vane assembly 12; a second vane assembly 14; a control means 16; a first converter means 18; and a second converter means 20.

Housing means 10 includes a base portion 22; a first housing portion 24 upstanding from base portion 22; and a second housing portion 26 upstanding from base portion 22 in axially spaced relation to housing portion 24. Housing portion 24 is cylindrical and defines a cylindrical combustion chamber 24*a* therewithin. Housing portion 26 is also cylindrical and defines a cylindrical combustion chamber 26*a* therewithin. Housing portions 24 and 26 are coaxial so that cylindrical combustion chambers 24*a* and 26*a* are also coaxial. A sparkplug or glowplug 28 is provided at the top dead center location in housing 24 and communicates with combustion chamber 24*a*, and intake and exhaust ports 30 and 32 are provided adjacent the lower end of the housing portion generally opposite plug 28. For example, the intake and exhaust ports may be located on opposite sides of, and each approximately 20 degrees from, the bottom dead center or six o'clock position on the housing portion. Similarly, a sparkplug or glowplug 34 is provided at the top dead center location in housing portion 26 and communicates with combustion chamber 26*a*, and intake and exhaust ports (not shown) are provided adjacent the lower end of the housing portion generally opposite plug 34. A suitable fuel mixture may be provided to intake port 30 of combustion chamber 24*a* by a fuel line 35 and a similar fuel line (not shown) provides a fuel mixture to the intake port of combustion chamber 26*a*.

Figure 3:
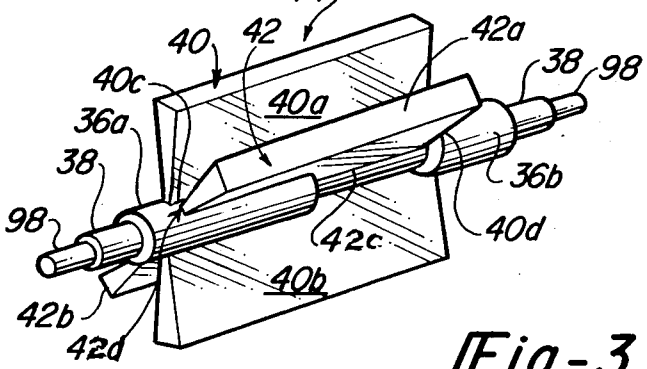
FIG. 3 is a perspective view of a vane and shaft subassembly utilized in the invention engine.

Vane subassembly 14, as best seen in FIGS. 1 and 3, is positioned within housing portion 26 and includes a first hollow shaft 36 including axially spaced separate portions 36*a* and 36*b*; a second hollow shaft 38 journalled concentrically within shaft 36; a first rotary vane 40 secured to shaft portions 36*a* and 36*b*; and a second vane 42 secured to shafts 38.

Vane 40 includes aligned first and second portions 40*a* and 40*a*. Portion 40*a* is secured to shaft portion 36*a* along inner vane edge 40*c* and is secured to shaft portion 36*b* at 40*d* with an intermediate inner vane edge portion 40*e* closely but slidably interfacing with shaft 38. Similarly, vane portion 40*b* is secured to shaft portion 36*a* along inner vane edge 40*c* and is secured to shaft portion 36*b* at 40*d* with intermediate vane edge portion 40*e* closely but slidably interfacing with shaft 38.

Vane 42 includes first and second portions 42*a* and 42*b*. Vane portion 42*a* is secured to shaft 38 along inner vane edge 42*c* and closely but slidably interfaces with shaft portion 36*a* at 42*d* and with shaft portion 36*b* at 42*e*. Vane portion 42*b* is similarly mounted and disposed with respect to shaft 38 and shaft portions 36*a* and 36*b*. Vanes 40 and 42 are configured to fit as tightly as possible within combustion chamber 26*a* without actually touching the chamber as they rotate relative to the chamber. If desired, an internal oil or lubricant may be used to protect the edges of the vanes and the adjacent walls of the chamber although, with proper control of the fit between the vanes and the walls of the combustion chamber, an internal lubricant may not be necessary. As seen, the vanes have a generally wedge-shaped configuration in cross section. Although other vane shapes may be used, the disclosed wedge shape is desirable because, as the vanes approach each other during their relative rotation within the combustion chamber, their faces move into a parallel relationship to minimize the danger of any protrusions on the faces of either vane coming into contact with the adjacent vane.

Vane assembly 12 is essentially a mirror image of vane assembly 14 and is positioned within combustion chamber 24*a*. Assembly 12 includes vanes 44 and 46 coacting with shaft portions 48*a* and 48*b* and with shaft 50 in the manner described with reference to assembly 14.

In the assembled relation of vane assemblies 12 and 14 within combustion chambers 24*a* and 26*a*, shaft portions 36*a* and 36*b* are suitably and respectively journalled in the opposite circular side walls 26*b* and 26*c* of housing portion 26 and shaft portions 48*a* and 48*b* are suitably and respectively journalled in circular side walls 24*b* and 24*c* of housing portion 24.

Control means 16 includes a housing 52, first ratchet means 54, and second ratchet means 56.

Housing 52 includes a rim portion 52*a* and a central hub portion 52*b*. Hub portion 52*b* is journalled on the confronting inboard ends of shafts 38 and 50 to mount housing 52 for rotation about the central longitudinal axis of the engine.

Figure 4:
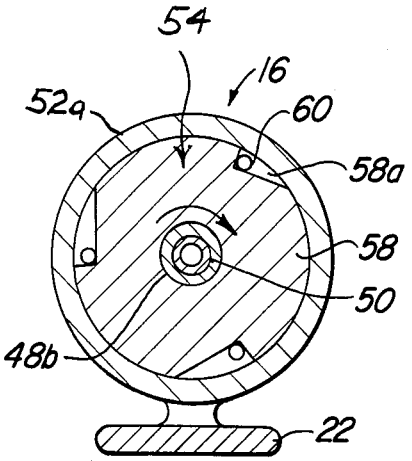

First ratchet means 54 includes a first circular ratchet body 58 secured to shaft portion 48*b* and a plurality of balls 60 respectively ensconced in a plurality of circumferentially spaced pockets 58*a* provided on the periphery of ratchet body 58, and a second circular ratchet body 62 secured to shaft 50 and including a plurality of balls 64 ensconced in a plurality of circumferentially spaced pockets (not shown) provided on the periphery of ratchet body 62. Ratchet bodies 60 and 62 are positioned within the left compartment 52*c* of housing 52 with the circular outer peripheries of the ratchet bodies interfacing with the adjacent circular inner periphery of housing rim portion 52*a*. As best seen in FIG. 4, ratchet bodies 58 and 62 and balls 60 and 64 coact in known manner with the adjacent inner periphery of housing rim portion 52*a* to preclude counterclockwise rotation of the shafts 48*b* and 50 relative to the housing 52, as viewed in FIG. 4, while allowing free clockwise rotation of the shafts relative to the housing 52.

Figure 5:
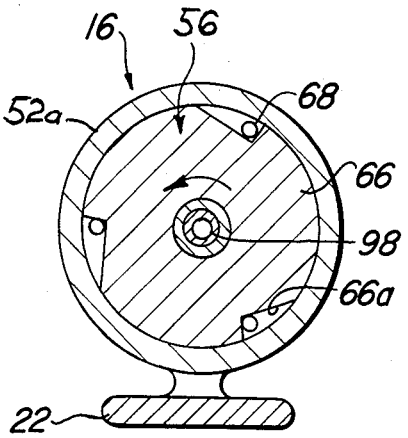

Second ratchet means 56 includes a first circular ratchet body 66 secured to shaft 36*a* and a plurality of balls 68 respectively ensconced in a plurality of circumferentially spaced pockets 66*a* provided on the periphery of ratchet body 66 and a second circular ratchet body 70 secured to shaft 38 and including a plurality of balls 72 respectively ensconced in a plurality of circumferentially spaced pockets (not shown) provided on the periphery of ratchet body 70. Ratchet bodies 66 and 70 are positioned in the righthand compartment 52*d* of housing 52 with the circular peripheries of the ratchet bodies interfacing with the adjacent circular inner periphery of rim portion 52*a* of housing 52 and with the ratchet bodies and balls coacting in known manner with the housing, and as best seen in FIG. 5, to preclude clockwise relative rotation of the respective shafts and the housing while allowing free relative counterclockwise rotation of the respective shafts and the housing.

Converter mechanism 18 includes a housing 74 constituting an output shaft for the converter mechanism, and a plurality of pinion bevel gears 76,78,80,82 positioned within housing 74. Pinion gear 76 is drivingly secured to shaft 50; pinion gear 78 is drivingly secured to shaft portion 48*a;* and pinion gears 80 and 82 are meshingly engaged with gears 76 and 78 and secured in axially spaced relation on a pinion shaft 84 which in turn is journalled at its upper and lower ends in journal portions 74*a* and 74*b* of housing 74.

Converter mechanism 20 is generally similar to mechanism 18 and includes a housing 86 constituting an output shaft for the converter mechanism and a plurality of pinion bevel gears 88,90,92 and 94 positioned within housing 86. Pinion gear 88 is drivingly secured to shaft 38; pinion 90 is drivingly secured to shaft portion 36*b;* and pinion gears 92 and 94 are meshingly engaged with gears 88 and 90 and secured in axially spaced relation on a pinion shaft 96 which in turn is journalled at its upper and lower ends in journal portions 86*a* and 86*b* of housing 86.

The invention engine further includes a central shaft 98 secured at its left end, as viewed in FIG. 1, to housing 74 and passing therefrom through converter mechanism 18, thence concentrically within shafts 50 and 48 through combustion chamber 24*a*, thence concentrically within shafts 50 and 38 through control means 16, thence concentrically within shafts 36 and 38 through combustion chamber 26*a*, and thence through converter mechanism 20 and through bearing means 86*c* provided at the right end of housing 86.

OPERATION

To start the engine, an electric motor (not shown) rotates the output shafts 74 and 86 to impart initial rotation to vanes 44,46 and 40,42. In order to impart differential rotation as well as absolute rotation to the vanes, a supercharger may be provided to supply a stream or charge of pressurized gas to the intake of each combustion chamber. This charge begins the compression and expansion strokes of the engine. Instead of a supercharger, a turbocharger, tank of compressed air, blower, or other suitable means for supplying gas can be used. For the sake of simplicity, a carburetor or other fuel mixing device is not shown in the drawings.

Figure 2:
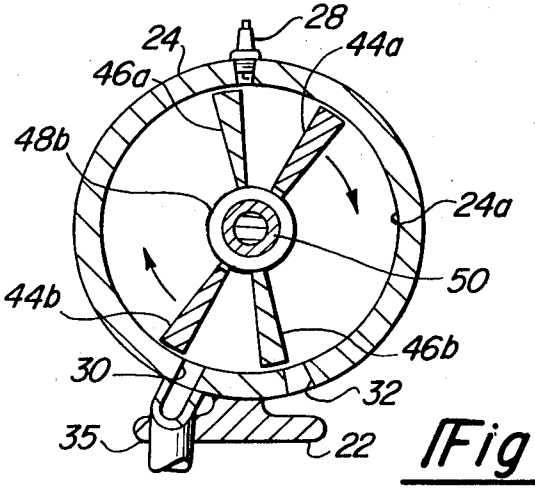
FIGS. 2, 4 and 5 are cross-sectional views taken on lines 2—2, 4—4 and 5—5 of FIG. 1, respectively.

The movement of vanes 44 and 46 through the various phases of the engine operation is best seen in FIG. 2. With the vanes 44 and 46 in the position seen in FIG. 2, the sparkplug 28 is energized to ignite the fuel mixture confined by vane portions 46*a* and 44*a*. As the fuel burns and expands, it acts against vane portion 44*a* to force vane 44 to rotate in a clockwise direction. Vane portion 46*a* is prevented from counterclockwise rotation by ratchet body 54. As vane portion 44*a* approaches vane portion 46*b*, combustion products from the previous ignition are expelled through exhaust port 32. At the same time, a new fuel air mixture is drawn in through intake 30 as vane portion 44*b* separates from vane portion 46*b* and the charge confined in the area between vane portion 44*b* and vane portion 46*a* is compressed. As vane portion 44*b* moves close to vane portion 46*a*, the buildup of pressure in the space between the two vane portions forces vane portion 46*a* to move past sparkplug 28 and a new charge is ready for firing to complete the cycle. Just before the sparkplug ignites the new charge, both vanes 44 and 46 are moving in a clockwise direction. After the firing, vane 46 decelerates and vane 44 accelerates. It can be shown that, for a given engine throttle setting, the output speed of driveshaft 74 of converter means 18 is constant as the vanes 44 and 46 alternately accelerate and decelerate during the engine cycle. When a particular vane is held stationary by its ratchet mechanism, the speed of the driveshaft 74 equals one half of the speed of the other or moving vane.

The movement of vanes 40 and 42 through the various phases of the engine operation is similar to that described with reference to vanes 44 and 46 with the exception that the ratchet mechanisms associated with vanes 40 and 42 function to resist clockwise movement of the vanes while freely allowing counterclockwise movement of the vanes. The result is that the reaction forces absorbed by the ratchet mechanisms associated with vanes 44 and 46 are counterbalanced by the reaction forces absorbed by the ratchet mechanisms associated with vanes 40 and 42.

When the operations of combustion chambers 24*a* and 26*a* are perfectly balanced, the reactive forces applied to the housing 52 of the control means 16 will cancel each other and the housing 52 will not rotate. If, however, the reaction forces become unbalanced, the housing 52 will begin to rotate. Slow rotation of the housing, for example, at 6 rpm, will have a negligible effect on engine performance. At this speed, and assuming the output shafts 74 and 86 are turning at 3600 rpms, the stop points of the vanes in the combustion chambers will be offset less than 0.15 degrees.

Excessive rotation of housing 52 can be controlled by several means. The most obvious way is to balance the output power or reaction forces from the two combustion chambers. Alternatively, a friction brake or clutch can be used to control rotation.

Figure 6:
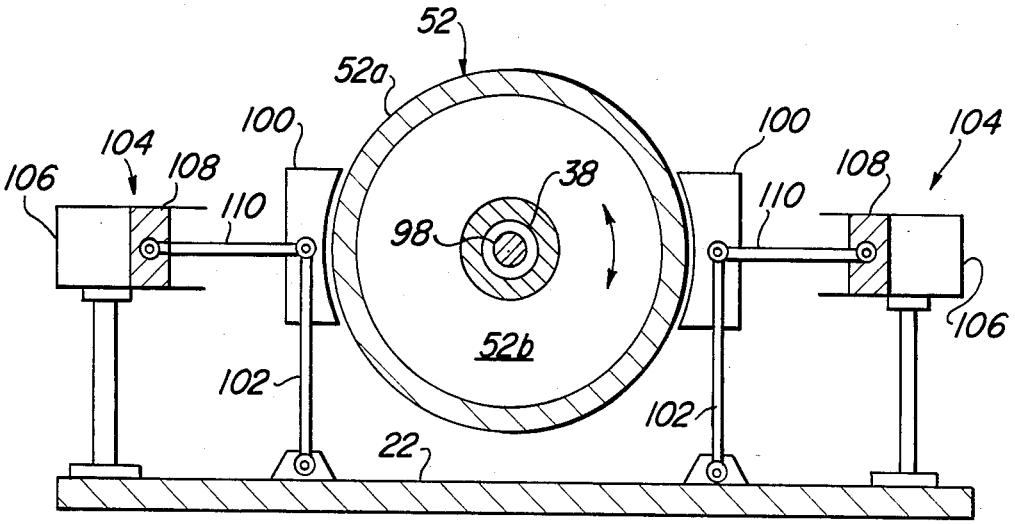
FIG. 6 is somewhat schematic view of a brake mechanism for use with the invention engine.

A suitable brake mechanism for the housing 52 is seen schematically in FIG. 6 and may include friction braking blocks 100 arranged to frictionally engage diametrically opposed sides of housing 52. Each block 100 may be mounted on a vertically oriented link 102 pivotally mounted at its lower end to base portion 22 and at its upper end to the block. Each block may be moved selectively into and out of frictional braking engagement with drum 52 by a hydraulic cylinder assembly 104 mounted on base portion 22 and including a cylinder 106, a piston 108, and a connecting rod 110 pivotally connected at its free outer end to block 100 at the pivotal connection of the block to the upper end of the link 102. It will be understood that cylinder assemblies 104 may be suitably controlled, either individually or in common, to selectively engage drum 52 and selectively preclude excessive rotation of the housing.

As a further alternative to control excessive rotation of housing 52, the housing can be connected to a coil spring that is attached to the base of the housing in order to control and limit its rotation.

The balancing of outputs from the two combustion chambers is facilitated because engine performance is inherently stable. If, for example, vane assembly 14 increases its power output relative to that of vane assembly 12 the reactive torque from assembly 14 will commensurately increase. The incremental torque, acting in the same direction as the rotation of the output shafts of assembly 12, will be translated through the ratchet housing to the shafts associated with assembly 12. This supplemental power will assist the assembly 12 in catching up with assembly 14.

Under ideal conditions, vibration from the invention engine will be essentially eliminated since all moving parts are rotating about their centers of gravity and all reactive forces within the engine are cancelled out. The engine is thus capable of speeds in the range between those of conventional internal combustion engines and gas turbines.

There are several potential aviation applications for the invention engine. For example, the engine could supply power to twin rotors of a helicopter. Further, the engine could be utilized to turn pusher-puller propellors on an airplane. The invention engine is also well suited to drive counterrotating props on an airplane. In this application, central drive shaft 98 would be utilized to enable the power from both combustion chambers to be taken off from the engine at the righthand end of the engine as viewed in FIG. 1.

The invention engine has been described in many respects in a conceptual or schematic manner. Further details with respect to the construction of the invention engine and it operation are disclosed in applicant's copending application Ser. No. 773,636, the disclosure of which is incorporated herein by reference.

Whereas a preferred embodiment of the invention has been illustrated and described in detail, it will be apparent that various changes may be made in the disclosed embodiment without departing from the scope or spirit of the invention.

What is claimed:

1. A drive assembly comprising:

(A) means defining first and second chambers arranged on a common fixed axis and axially spaced;

(B) a first pair of vanes mounted in said first chamber for independent rotation about said axis;

(C) a second pair of vanes mounted in said second chamber for independent rotation about said axis;

(D) a first pair of concentric drive shafts positioned on said axis and respectively drivingly secured to said first pair of vanes;

(E) a second pair of concentric drive shafts positioned on said axis and respectively drivingly secured to said second pair of vanes;

(F) a housing positioned between said axially spaced chambers and mounted for rotation about said axis;

(G) first control means drivingly interconnecting said first pair of drive shafts to said housing and operative to allow clockwise movement of said first pair of drive shafts relative to said housing while precluding relative counterclockwise movement, so that said first pair of vanes may rotate freely in said first chamber in a clockwise direction and may simultaneously undergo relative rotation;

(H) second control means drivingly interconnecting said second pair of drive shafts to said housing and operative to allow counterclockwise movement of said second pair of drive shafts relative to said housing while precluding relative clockwise movement, so that said second pair of vanes may rotate freely in said second chamber in a counterclockwise direction and may simultaneously undergo relative rotation;

(I) first converter means, including a first output shaft, drivingly connected to said first pair of vanes and operative to convert the clockwise rotation of said first pair of vanes and the relative rotation of said first pair of vanes into unidirectional rotation of said first output shaft; and (J) second converter means, including a second output shaft, drivingly connected to said second pair of vanes and operative to convert the counterclockwise rotation of said second pair of vanes and the relative rotation of said second pair of vanes into unidirectional rotation of said second output shaft.

2. A drive assembly according to claim 1 wherein:

(K) said first pair of concentric drive shafts extend axially out of one side of said first chamber for connection to said first control means and extend axially out of the other side of said first chamber for connection to said first converter means; and (L) said second pair of concentric drive shafts extend axially out of one side of said second chamber for connection to said second control means and extend axially out of the other side of said second chamber for connection to said second converter means.

3. A drive assembly according to claim 2 wherein said assembly further includes:

(M) a central output shaft positioned on said axis rotatably within said first and second pairs of concentric shafts and extending from said first output shaft, through said first chamber, through said housing, through said second chamber, and through said second converter means so as to deliver the power from both output shafts to one end of said assembly for appropriate power takeoff.

4. A drive assembly according to claim 3 wherein:

(N) said drive assembly comprises a rotary internal combustion engine;

(O) said first and second chambers comprise first and second combustion chambers;

(P) ignition means, an intake port, and an exhaust port are provided in association with each combustion chamber; and (Q) means are provided for supplying a combustible fuel mixture to each combustion chamber so that said respective vanes may rotate in the respective permitted direction and undergo relative rotation to define an intake, compression, ignition, and exhaust phase for the respective combustion chamber.

5. A drive assembly according to claim 1 wherein said assembly further includes:

(K) braking means engaging said housing and operative to selectively brake said housing to preclude excessive rotation of said housing about said axis.

6. An internal combustion engine comprising:

(A) means defining a pair of generally cylindrical combustion chambers arranged on a common axis and axially spaced to define a space therebetween;

(B) a first pair of vanes mounted in said first combustion chamber for independent rotation about said axis;

(C) a second pair of vanes mounted in said second combustion chambers for independent rotation about said axis;

(D) a first pair of concentric drive shafts positioned on said axis and respectively drivingly secured to said first pair of vanes;

(E) a second pair of concentric drive shafts positioned on said axis and respectively drivingly secured to said second pair of vanes;

(F) a housing positioned in said space between and mounted for rotation about said axis;

(G) first ratchet means drivingly interconnecting said first pair of drive shafts to said housing and operative to allow clockwise movement of said first pair of drive shafts relative to said housing while precluding relative counterclockwise movement, so that said first pair of vanes may rotate freely in said first chamber in a clockwise direction and may simultaneously undergo relative rotation;

(H) second ratchet means drivingly interconnecting said second pair of drive shafts to said housing and operative to allow counterclockwise movement of said second pair of drive shafts relative to said housing while precluding relative clockwise movement, so that said second pair of vanes may rotate freely in said second chamber in a counterclockwise direction and may simultaneously undergo relative rotation;

(I) first converter means, including a first output shaft, drivingly connected to said first pair of vanes and operative to convert the clockwise rotation of said first pair of vanes and the relative rotation of said first pair of vanes into unidirectional rotation of said first output shaft;

(J) second converter means, including a second output shaft, drivingly connected to said second pair of vanes and operative to convert the counterclockwise rotation of said second pair of vanes and the relative rotation of said second pair of vanes into unidirectional rotation of said second output shaft;

(K) an ignition device communicating with each combustion chamber;

(L) at least one intake port in each combustion chamber spaced circumferentially from the associated ignition device;

(M) at least one exhaust port in each combustion chamber spaced circumferentially from the associated ignition device and the associated intake port; and (N) means for delivering a fuel charge to each of said combustion chambers.

7. An internal combustion engine according to claim 6 wherein:

(O) said first pair of concentric drive shafts extend axially out of one side of said first combustion chamber for connection to said first ratchet means and extend axially out of the other side of said first combustion chamber for connection to said first converter means; and (P) said second pair of concentric drive shafts extend axially out of one side of said second combustion chamber for connection to said second ratchet means and extend axially out the other side of said second combustion chamber for connection to said second converter means.

8. An internal combustion engine according to claim 7 wherein said assembly further includes:

(Q) a central output shaft positioned on said axis rotatably within said first and second pairs of concentric shafts and extending from said first output shaft, through said first combustion chamber, through said housing, through said second combustion chamber, and through said converter means so as to deliver the power from both output shafts to one end of said engine for appropriate power takeoff.

* * * * *